US009336731B2

(12) United States Patent
Long et al.

(10) Patent No.: US 9,336,731 B2
(45) Date of Patent: May 10, 2016

(54) SYSTEM AND METHOD TO COMPENSATE FOR AN INDUCED VOLTAGE ON A PIXEL DRIVE ELECTRODE

(75) Inventors: John James Long, Hertford (GB); Stephen Markham, Cambridge (GB); Gareth Husbands, Ely (GB)

(73) Assignee: FLEXENABLE LIMITED, Cambridge, Cambridgeshire (GB)

( * ) Notice: Subject to any disclaimer, the term of this patent is extended or adjusted under 35 U.S.C. 154(b) by 167 days.

(21) Appl. No.: 14/111,532

(22) PCT Filed: Apr. 13, 2012

(86) PCT No.: PCT/GB2012/050813

§ 371 (c)(1),
(2), (4) Date: Dec. 23, 2013

(87) PCT Pub. No.: WO2012/140434

PCT Pub. Date: Oct. 18, 2012

(65) Prior Publication Data

US 2014/0104155 A1 Apr. 17, 2014

(30) Foreign Application Priority Data

Apr. 14, 2011 (GB) ..... 1106350.0

(51) Int. Cl.
*G09G 3/34* (2006.01)
*G09G 3/36* (2006.01)

(52) U.S. Cl.
CPC ..... *G09G 3/344* (2013.01); *G09G 3/3655* (2013.01); *G09G 2300/0876* (2013.01); *G09G 2320/029* (2013.01); *G09G 2320/0219* (2013.01); *G09G 2320/0693* (2013.01)

(58) Field of Classification Search
CPC ..... G09G 3/344; G09G 3/3655; G09G 2320/029; G09G 2320/0693; G09G 2320/0219; G09G 2300/0876
See application file for complete search history.

(56) References Cited

U.S. PATENT DOCUMENTS 6,229,510 B1 5/2001 Kim et al.
2005/0041004 A1 2/2005 Gates et al.

(Continued)

FOREIGN PATENT DOCUMENTS

KR 2010-0071702 6/2010
WO WO 01/47043 A1 6/2001

(Continued)

OTHER PUBLICATIONS

Examination Report issued in Application No. EP12717823.4, dated Oct. 22, 2014.

(Continued)

*Primary Examiner* — Larry Sternbane
*Assistant Examiner* — Darlene M Ritchie
(74) *Attorney, Agent, or Firm* — Knobbe Martens Olson & Bear LLP

(57) ABSTRACT

We describe a display system comprising an electrooptic display coupled to a display driver and including an induced voltage compensation circuit. The compensation circuit comprises a system to measure a voltage applied a common pixel electrode of the display, and one or both of: a system to measure a voltage swing on a pixel select line of the display, and a system to measure a change in voltage on the common pixel electrode due to a voltage induced on a pixel drive electrode of the display. The compensation circuit also includes a system to apply a voltage to the common pixel electrode, responsive to a combination of the measured applied voltage and one or both of the measured voltage swing and the measured change in voltage, to compensate for the induced voltage.

34 Claims, 7 Drawing Sheets

(56) References Cited

U.S. PATENT DOCUMENTS

| | | | | |
|---|---|---|---|---|
| 2005/0212735 | A1* | 9/2005 | Lin | 345/87 |
| 2006/0145995 | A1 | 7/2006 | Kim et al. | |
| 2006/0181492 | A1 | 8/2006 | Gates et al. | |
| 2007/0024560 | A1 | 2/2007 | Kim et al. | |
| 2007/0052646 | A1 | 3/2007 | Ishiguchi | |
| 2007/0115274 | A1 | 5/2007 | Shih | |
| 2007/0164963 | A1* | 7/2007 | Kim et al. | 345/98 |
| 2007/0211006 | A1 | 9/2007 | Lee et al. | |
| 2007/0229429 | A1 | 10/2007 | Yu et al. | |
| 2008/0198122 | A1 | 8/2008 | Shin et al. | |
| 2009/0040412 | A1 | 2/2009 | Lee et al. | |
| 2010/0149158 | A1* | 6/2010 | Lee | 345/211 |
| 2010/0277400 | A1* | 11/2010 | Jeong | 345/76 |
| 2011/0037787 | A1* | 2/2011 | Yoshiga | 345/690 |
| 2011/0221983 | A1* | 9/2011 | Lee | 349/33 |

FOREIGN PATENT DOCUMENTS

| | | | |
|---|---|---|---|
| WO | WO 01/47045 | A1 | 6/2001 |
| WO | WO 2004/070466 | A1 | 8/2004 |
| WO | WO 2005/020199 | A2 | 3/2005 |
| WO | WO 2006/056808 | A1 | 6/2006 |
| WO | WO 2006/059162 | A1 | 6/2006 |
| WO | WO 2006/061658 | A1 | 6/2006 |
| WO | WO 2006/106365 | A2 | 10/2006 |
| WO | WO 2007/029028 | A1 | 3/2007 |
| WO | WO 2009/133388 | A1 | 11/2009 |
| WO | WO 2010/066806 | A1 | 6/2010 |
| WO | WO 2011/064578 | A1 | 6/2011 |

OTHER PUBLICATIONS

Combined Search and Examination Report issued in Application No. GB1312192.6, dated Jan. 23, 2014.

Examination Report issued in Application No. GB1206529.8, dated Jan. 24, 2014.

International Search Report and Written Opinion re International Application No. PCT/GB2012/050813, dated Jul. 11, 2012.

Search Report issued in Application No. GB1206529.8, dated Jul. 29, 2011.

Combined Search and Examination Report issued in Application No. GB1206529.8, dated Aug. 14, 2012.

European Office Action for European Application No. 12717823.4 dated Mar. 3, 2016 in 11 pages.

* cited by examiner

SYSTEM AND METHOD TO COMPENSATE FOR AN INDUCED VOLTAGE ON A PIXEL DRIVE ELECTRODE

CROSS-REFERENCE TO RELATED APPLICATIONS

This application is the U.S. National Phase under 35 U.S.C. §371 of International Application No. PCT/GB2012/050813, filed Apr. 13, 2012, designating the United States and published in English on Oct. 18, 2012 as WO 2012/140434, and which claims priority to United Kingdom Application No. 1106350.0, filed Apr. 14, 2011.

FIELD OF THE INVENTION

This invention relates to circuits and methods for compensating for gate kickback in electro-optic displays. The techniques are particularly advantageous in electrophoretic displays.

BACKGROUND TO THE INVENTION

In a typical active matrix display each pixel is provided with a transistor, more particularly a thin film field effect transistor (TFT, FET) which is used to control the appearance of the pixel. Broadly speaking, the gate connection of the FET is connected to a select line to select the pixel for writing data, and one of the source and drain of the FET is connected to a data line for writing data to the pixel, the other being connected to a pixel electrode for driving the display medium. In some types of display, in particular electrophoretic displays the pixel electrodes are located on one face of the display medium and a common electrode is provided covering the opposite face of the display medium thereby enabling an electric field to be provided across the display medium, for example to switch the device from one display state, say white, to another say black (or vice versa). The skilled person will appreciate that pixel circuits may in practice be more complex than this, but the same general features remain.

One problem in such displays is parasitic capacitance between the gate and pixel electrodes; in an electrophoretic display this can be exacerbated by the presence of the common pixel electrode, which is used to provide a bigger pixel capacitance. A consequence of this parasitic capacitance is that the voltage applied to a pixel electrode ends up being different to the voltage applied to the corresponding data line of the display, the actual pixel voltage being off set from that applied. This is, in effect, a side effect of the parasitic capacitances in the display when the gate connection is on, and this "kickback" has a deleterious effect on the visual appearance of the electrophoretic display.

WO 2005/020199 describes an electrooptic display with a writing mode and a non-writing mode, the display being arranged to apply a first voltage to the common electrode when the display is in its writing mode and a second voltage, different from the first voltage, when the display is in its non-writing mode. In embodiments (FIGS. 4 and 5) a sensor pixel approach is described, the purpose of these pixels being to provide an indication of the required feedthrough voltage; in another embodiment (FIG. 9) an approach is described which uses an internal adjustment which does not require the presence of sensor pixels, instead substituting a capacitor. In a still further embodiment (FIG. 10) a controller is used to control the voltage offset between the voltage applied to the common electrode when the display is in its non-writing mode ($V_{SM}$) and the voltage applied to the common electrode when the display is in its writing mode ($V_{COM}$). Other systems are described in US2007/211006, US2008/198122, US2009/040412 and WO2005/020199.

Background prior art can be found in WO2011/064578 and WO2005/020199.

We have previously described, in WO/2011/064578, techniques for compensating gate kickback which offset a value of a common voltage on the common electrode by an offset value dependent on a difference between a magnitude of a positive gate voltage and a magnitude of a negative gate voltage.

We now describe improved techniques for compensating gate kickback.

SUMMARY OF THE INVENTION

We have previously described a method of compensating for gate kickback in an electrooptic display, the display comprising an electrooptic display medium having a plurality of pixels and being mounted on a backplane, said backplane bearing a plurality of pixel driver circuits for said plurality of pixels, each said pixel driver circuit comprising a transistor having drain, source and gate connections, one of said drain and source connections being electrically coupled to a pixel electrode of a respective pixel, said gate electrode being electrically coupled to a gate drive line of said electrooptic display, said pixel driver circuit further having a common electrode, said common electrode being coupled to provide a common electrode connection for a plurality of said pixels, wherein, in use, a gate voltage on said gate drive line is controlled between a positive gate voltage with respect to a common voltage on said common pixel electrode and a negative gate voltage with respect to said common voltage on said common electrode to control information displayed by a pixel of said electrooptic display, and wherein the method comprises compensating gate kickback when driving said display, said gate kickback comprising a change in voltage across a said pixel electrode and said common electrode arising from capacitive coupling in said electrooptic display between a said gate drive line and a said pixel electrode, wherein said compensating comprises offsetting a value of said common voltage on said common electrode by an offset value dependent on a difference between a magnitude of said positive gate voltage and a magnitude of said negative gate voltage.

In general, when an electrooptic, in particular an electrophoretic, display is manufactured each display has a different parasitic capacitance and, in general, there may also be variations in the positive and negative gate voltages employed and hence in the gate voltage swing. The inventors determined that, surprisingly, the shift or offset between the voltage applied across the data and common connections of the display, and the voltage actually appearing across the pixel electrode of a pixel and the common pixel electrode, is a function of the change in gate voltage, more particularly of the difference between the positive and negative gate voltages employed. In embodiments the display is a monochrome display and the positive and negative gate/source voltages, and external (maximum/minimum) values between which the pixel electrode is switched, broadly correspond to "black" and "white" pixel values. The skilled person will appreciate, however, that in principle the technique may also be applied to a colour electrooptic display.

The methods we describe here and below are especially advantageous in the case of an electrooptic display/backplane on a flexible substrate, such as a plastic substrate, for example a thin sheet of PET (polyethylenetertphthalate) or PEN (polyethylenenaphthalate). This is because these tend to have a large parasitic capacitance and thus a relatively large fraction of the gate voltage swing is coupled to the pixel capacitor. The problems do not arise to the same degree in, say, an active matrix display fabricated on a glass substrate.

Preferably in the devices we describe here and later the backplane is fabricated using solution-based thin film transistors (TFTs) preferably patterned by techniques such as direct-write printing, laser ablation or photolithography. Further details can be found in the applicant's earlier patent applications, including, in particular, WO 01/47045, WO 2004/070466, WO 01/47043, WO 2006/059162, WO 2006/056808, WO 2006/061658, WO 2006/106365 (which describes a four or five layer pixel architecture) and WO2007/029028, all hereby incorporated by reference in their entirety. Thus the TFTs may comprise an organic semiconductor material, for example a solution processable conjugated polymeric or oligomeric material, and some preferred implementations the display, more particularly the backplane, is adapted to solution deposition, for example comprising solution-processed polymers and vacuum-deposited metals.

The offset value for a particular display varies from display to display and the display may thus be one-time-programmed with the offset value, for example, at manufacture. This programming may be performed manually, for example by performing electrical and/or optical tests to determine an optimum value for the common electrode voltage dependent on the gate voltage swing (in a simple approach relying on observed visual quality of the display). However this can be time consuming.

In preferred implementations of the method, therefore, an electronic circuit is built into the display to automatically adjust the offset voltage value dependent on the gate voltage swing (although it is not essential to build such a circuit into the display). In embodiments of this approach a digital input to a digital-to-analogue converter (DAC) is used to set a value for the common voltage and a reference voltage level input to the DAC is controlled by a differential amplifier (the gain of which may be less than unity), the differential amplifier having the positive and negative gate drive voltages for the display as to inputs. (Alternatively, the digital input may be used to set the offset value and the reference input the common voltage level).

The offset voltage value is dependent upon a difference between the magnitude of the positive gate voltage and the magnitude of the negative gate voltage, but, in embodiments, a simple difference between the positive and negative gate voltage values i.e. the gate voltage swing, may be employed to control the reference level of the DAC. In embodiments the offset to the common voltage is linearly dependent on more particularly proportional to the positive-negative gate voltage swing (where these positive and negative gate voltage values define reference voltage values typically maximum and minimum voltage values for the pixel electrodes). The constant of proportionality is a function of the display, and hence, although this approach dynamically controls the value of the common voltage, this control is used to control for manufacturing variations and, in embodiments, is not used for dynamic control during operation of the device based upon varying positive and negative gate voltage values—these are typically fixed by the design of the display. (The skilled person will appreciate that although reference is made to positive and negative gate voltage values, these are with respect to the value of the common voltage and, depending upon the ground reference, the negative gate voltage may be considered to be a zero level in which case the common voltage is between, approximately halfway between this (arbitrary) zero voltage level and the positive gate voltage).

We have also described an electrooptic display and/or an electronic document reading device including such a display, programmed with a common voltage offset value using a method as described above.

We have also described an electrooptic display, the display comprising an electrooptic display medium having a plurality of pixels and being mounted on a backplane, said backplane bearing a plurality of pixel driver circuits for said plurality of pixels, each said pixel driver circuit comprising a transistor having drain, source and gate connections, one of said drain and source connections being electrically coupled to a pixel electrode of a respective pixel, said gate electrode being electrically coupled to a gate drive line of said electrooptic display, said pixel driver circuit further having a common electrode, said common electrode being coupled to provide a common electrode connection for a plurality of said pixels, wherein, in use, a gate voltage on said gate drive line is controlled between a positive gate voltage with respect to a common voltage on said common pixel electrode and a negative gate voltage with respect to said common voltage on said common electrode to control information displayed by a pixel of said electrooptic display, the display further comprising a gate kickback compensation circuit for compensating gate kickback when driving said display, said gate kickback comprising a change in voltage across a said pixel electrode and said common electrode arising from capacitive coupling in said electrooptic display between a said gate drive line and a said pixel electrode, wherein said compensation circuit is configured to offset a value of said common voltage on said common electrode by an offset value dependent on a difference between a magnitude of said positive gate voltage and a magnitude of said negative gate voltage.

Preferably in these, and later in described devices, the electrooptic display is a flexible display, for example, having a plastic substrate, in embodiments incorporating an electrophoretic display medium.

In general the display (with driver) includes first and second gate voltage supplies to provide the positive and negative gate voltages; these may simply be power supply lines to the display but preferably will comprise a positive and negative bias voltage generators. The gate kickback compensation circuit may comprise a differential amplifier (in embodiments with a gain of less than unity having a first input coupled to the positive gate voltage supply and a second input coupled to the negative gate voltage supply, and having an output coupled to drive the reference input to a DAC, a digital input to the DAC in combination with the reference level input determining the common voltage. Alternatively (but less preferably) the output of the differential amplifier may be used to determine a digital input to the DAC and the reference input to the DAC may be provided with a (fixed) reference value to control the common voltage level via the output of the DAC. The skilled person will appreciate that, in principal, either of the digital input and the reference level input of the DAC may be used to determine the "base" value of the common voltage, the other input to the DAC being used to control the offset to this common voltage.

The displays and methods we describe herein are particularly useful in an electronic document reading device.

Improved Techniques

We now describe some improved techniques for setting the common pixel electrode (VCOM) supply voltage, and for maintaining an accurate setting, in particular by tracking drift in the display kickback voltage which can occur, for example, due to ageing and/change in temperature.

According to the present invention there is therefore provided a display system comprising an electrooptic display coupled to a display driver, the electrooptic display comprising a plurality of pixels each with a pixel drive electrode driven by a pixel driver circuit, said plurality of pixels sharing a common pixel electrode, a said pixel driver circuit comprising a pixel select line to select the pixel, a pixel data line to receive pixel data for driving the pixel, and a pixel drive line coupled to said pixel drive electrode to drive said pixel drive electrode with a signal dependent on said pixel data, said induced voltage comprising a voltage induced on said pixel drive electrode by a changing voltage on said pixel select line, said display driver including an induced voltage compensation circuit comprising: a system to measure a voltage applied said common pixel electrode; and one or both of: a system to measure a voltage swing on said pixel select line; and a system to measure a change in voltage on said common pixel electrode due to said voltage induced on said pixel drive electrode; and a system to apply a voltage to said common pixel electrode, responsive to a combination of said measured applied voltage and one or both of said measured voltage swing and said measured change in voltage, to compensate for said induced voltage.

This arrangement enables one or both of two different types of, in effect, closed loop feedback to be applied to the induced voltage (gate kickback) compensation system, either applying the loop around the circuitry generating the kickback compensation voltage, or around the display in addition to this circuitry or both. In the latter case, for example, the closed loop around the voltage compensation circuitry may be applied initially to correct gain and off-set errors in this circuitry, and then the closed loop including the display may be employed to track drift in the display parasitic capacitance during the lifespan of the display and/or with temperature change.

The skilled person will recognise that the induced voltage is, generally, a voltage induced by capacitative coupling between conductive elements. Thus, as used herein, an induced voltage is, generally, voltage induced by a charge on a conductive element.

In embodiments non-volatile memory in the display driver stores display compensation data defining a relationship between a voltage swing on the pixel select line and the induced voltage on the pixel drive electrode. The display compensation data in effect stores a value of the parameter "k" (referred to later), although in practice the stored value may represent a scaled and/or off-set value of this parameter. Then the display driver may be configured to adjust the voltage applied to the common pixel electrode to bring the measured applied voltage towards a gate kickback compensation voltage calculated from this display compensation data and the measured (gate) voltage swing on the pixel select line.

The skilled person will appreciate that in some preferred embodiments the voltage swing is measured by measuring a difference between the maximum and minimum applied (gate) voltages rather than by measuring the swing i.e. change itself.

In some preferred implementations the measurement and adjusting is performed by the display driver, more particularly by a processor of the display driver under programme code control. However the skilled person would appreciate that in other alternative embodiments dedicated hardware (analogue and/or digital) may be employed for this purpose. In general the techniques we describe herein may be implemented by hardware, software, or a combination of the two.

In some preferred implementations the systems to measure the voltage applied to the common pixel electrode and the voltage swing on the pixel select line comprise and analogue-to-digital converter with a switch to switch the analogue input between a voltage dependent on the voltage swing, and a voltage dependent on the voltage applied to the common pixel electrode. For example the voltage dependent on the voltage swing may be derived from the output of a differential amplifier amplifying the difference between positive and negative (gate) voltages applied to the pixel select line when writing data to a pixel, preferably scaled with a gain of less than unity (to bring the voltage within a reasonable range for the ADC input). Similarly the common pixel electrode voltage (VCOM) may be reduced by a potential divider (for example of ratio 10:1) prior to input to the ADC. Using a common analogue-to-digital converter (ADC) with a switched front end has the advantage of using a common "voltmeter" for the measurements, thus reducing potential sources of error. As will be explained in detail later, even small errors can make a significant difference.

In some preferred embodiments the system is also configured to measure the change in voltage on the common pixel electrode due to the voltage induced on the pixel drive electrode, in effect directly measuring the gate kickback voltage. The display driver (processor) may then adjust the voltage applied to the common pixel electrode to substantially exactly compensate for this. Although in theory a simpler approach to that previously described, in practice it can be difficult to get this approach to work well.

Thus in an preferred implementation of the system the common pixel electrode of the display is provided with a common pixel electrode switch to switch between a first setting in which the common pixel electrode is driven with the compensation voltage, and a second setting in which the common pixel electrode is disconnected from the voltage drive and connected to an induced (kickback) voltage measurement system. Preferably the common pixel electrode switch has a third setting in which the common pixel electrode is "off", that is the connection to this electrode is in a high impedance state so that the common pixel electrode is substantially disconnected from the display driver circuitry. In this way the common pixel electrode can be disconnected when not being driven or measured, to reduce "accidental" discharge by removing a discharge path. In preferred embodiments the system for measuring the induced (kickback) voltage comprises a third setting of the switch or multiplexer connected to the analogue input of the ADC so that the (same) ADC can be used to measure the voltage induced on the common pixel electrode. However, preferably a very high input impedance buffer is included between the common pixel electrode, more particularly the common pixel electrode switch, and the ADC input, more particularly the ADC input switch (multiplexer). In some preferred embodiments this buffer (which may or may not have unity gain) has an input impedance of greater than 10 MΩ, for example around 100 MΩ; it may be implemented using an operational amplifier connected as a voltage follower.

In some preferred embodiments the system to apply a voltage to the common pixel electrode comprises and analogue-to-digital converter configured to multiply a scaled version of the voltage swing on the pixel select line by a signal or value indicating the voltage to apply to the common pixel electrode, to apply a voltage scaled by this voltage swing. Conveniently the (scaled) voltage swing signal is applied to a reference input of the DAC and a digital value for the voltage to apply is applied to the digital input of the DAC, although the skilled person will recognise that the roles of the digital and reference inputs to the DAC may be reversed. In embodiments a signal proportional to the gate voltage swing is added to the DAC output to off-set the DAC output voltage by a scaled version of this voltage swing. This facilitates achieving more precise control of the applied voltage within a desired general range.

In some particularly preferred embodiments of the display system, the pixel driver circuitry is fabricated on a flexible substrate, in particular a plastic back plane, using solution deposition techniques, and the electro optic display is an electrophoretic display. Advantageously such a display system may be incorporated into an electronic document reading device.

In an alternative preferred embodiment, an ADC is configured to act as a voltmeter to measure the voltage that may be applied to the common pixel electrode. The system is configured to determine an ideal operation voltage for the common pixel electrode which is dependent upon a combination of the reference voltage input of the DAC, a voltage offset (the minimum voltage applied to the common pixel electrode as measured by the ADC), and a voltage span, which is determined from the difference between a maximum voltage applied to the common pixel electrode as measured by the ADC and the minimum voltage. The system is configured to determine a correction to the voltage applied to the common pixel electrode in response to the determined ideal operation voltage.

Broadly speaking, an advantage of this system to set the voltage of the common pixel electrode is that the system does not require knowledge of any feedback resistor values and thus, does not need to know the value of the differential amplifier voltage gain (as described above). This enables the system to set VCOM with any practical value of the resistors and amplifier voltage.

The ideal operation voltage is determined from a difference between the reference voltage input of the DAC and the voltage offset, scaled by the voltage span.

In this embodiment, the display system is configured to determine the digital input of the DAC and to set the voltage applied to the common pixel electrode in response to the ideal operation voltage for the common pixel electrode and a maximum digital input value of the DAC.

However, since there may be additional gain and offset errors present in the system, it is desirable to determine an error in a voltage on the digital input of the DAC and to correct for the error. In preferred embodiments, the display system may perform a procedure to determine an error in a voltage on the digital input of the DAC used to set the applied voltage. The error is a function of the maximum digital input value of the DAC and is dependent upon the ideal operation voltage of the common pixel electrode, the measured voltage applied to the common pixel electrode and the voltage span of the DAC.

Preferably, the system implements an error correction procedure to correct for the error in the voltage on the digital input. The error correction procedure comprises determining the error in the voltage, adjusting the digital input value by adding the determined error to the digital input and iterating the procedure until the absolute magnitude of the error is less than the resolution of the DAC.

Similar techniques may be employed in embodiments of the methods of aspects of the invention as described below. Thus, these methods may include compensating for an induced voltage in an electrooptic display coupled to a display driver by determining an ideal operation voltage for the common pixel electrode as measured by an ADC, determining the digital input of the DAC and setting the voltage applied to the common pixel electrode, determining an error in the voltage on the digital input and implementing an error correction procedure to correct for the error in the voltage on the digital input, as described above.

In a first related aspect there is provided a display system comprising an electrooptic display coupled to a display driver, the electrooptic display comprising a plurality of pixels each with a pixel drive electrode driven by a pixel driver circuit, said plurality of pixels sharing a common pixel electrode, a said pixel driver circuit comprising a pixel select line to select the pixel, a pixel data line to receive pixel data for driving the pixel, and a pixel drive line coupled to said pixel drive electrode to drive said pixel drive electrode with a signal dependent on said pixel data, said induced voltage comprising a voltage induced on said pixel drive electrode by a changing voltage on said pixel select line, said display driver including an induced voltage compensation circuit comprising: a system to measure a voltage applied said common pixel electrode; and one or both of: a system to measure a voltage swing on said pixel select line; and a system to measure a change in voltage on said common pixel electrode due to said voltage induced on said pixel drive electrode; and a system to apply a voltage to said common pixel electrode, responsive to a combination of said measured applied voltage and one or both of said measured voltage swing and said measured change in voltage, to compensate for said induced voltage.

Again preferred embodiments of the method are applied to an electrophoretic display on a plastic back plane on which (organic) thin film transistors are fabricated by solution deposition techniques.

Broadly speaking the display is characterised at manufacture to provide the display compensation data, which represents the internal parasitic capacitance of a pixel driver circuit, more particularly a degree of coupling between the pixel select line and the pixel drive line. This in turn defines a compensation voltage to apply to the common pixel electrode. However the voltage compensation driver circuitry will in general exhibit gain and off-set tolerances, and these are particularly a problem for electrophoretic displays since these have a built-in memory so that a small off-set voltage, over time, can cause a general drift of the display, for example towards black or white. The method is applied in the context of a circuit in which the actual voltage swing on the pixel select line (the difference between positive and negative gate drive voltages) is used in combination with a scaling parameter (k) characterising the internal, parasitic capacitance within the display, to determine the (kickback) compensation voltage to apply to the common pixel electrode. Thus embodiments of the method know the desired compensation voltage and the characterising parameter k (which is determined at manufacture) and determine the pixel select line voltage swing and actually applied compensation voltage, so that the actually applied compensation voltage can be adjusted to match that desired.

More particularly, in embodiments, the voltage swing on the pixel select line is determined from a difference between positive and negative pixel select (gate) voltage supply lines and a scaled version of this is used as a reference signal level input for a digital-to-analogue converter (DAC). An initial value for the desired compensation voltage is calculated from this measured voltage swing and the stored parameter k, and this digital value is applied to the digital input of the DAC and adjusted (iteratively) to bring the actual compensation voltage closer to that desired. The iterative process may be continued until the error is less than the DAC resolution. In this way gain and off-set variations in the voltage compensation driver circuitry are effectively removed.

As previously mentioned, some embodiments add a voltage off-set to the analogue output of the DAC proportional to the determined voltage swing, to provide more accurate control. In embodiments this may be conveniently achieved by adding a proportion of the reference signal (voltage) input to the DAC to the analogue output of the DAC, for example using a resistive adder.

In a second related aspect the invention provides a method of compensating for an induced voltage in an electrooptic display coupled to a display driver, said electrooptic display having a plurality of pixels each with a pixel drive electrode driven by a pixel driver circuit, said plurality of pixels sharing a common pixel electrode, a said pixel driver circuit comprising a pixel select line to select the pixel, a pixel data line to receive pixel data for driving the pixel, and a pixel drive line coupled to said pixel drive electrode to drive said pixel drive electrode with a signal dependent on said pixel data, said induced voltage comprising a voltage induced on said pixel drive electrode by a changing voltage on said pixel select line, the method comprising: writing a reference pixel data value to a said pixel; measuring a voltage, more particularly a change in voltage, on said common pixel electrode due to said voltage induced on said pixel drive electrode; adjusting a voltage compensation driver circuit coupled to said common pixel electrode, responsive to said measured change in voltage, to apply a compensation voltage to said common pixel electrode to compensate for said measured change in voltage.

Broadly speaking embodiments of this method employ a control loop which includes the display itself. In embodiments the reference pixel data value defines a zero value of the signal on the pixel drive electrode, more particularly a zero voltage state. For an electrophoretic display this corresponds to no change in the (black/white) state of the display. In embodiments a plurality of such "null" pixel values are written to a pixel, in embodiments as part of a set of null frames. The average induced voltage may then be determined from this process and the voltage compensation driver circuit may be controlled so that the compensation voltage applied to the common pixel electrode substantially exactly matches the measured (averaged) induced voltage value.

This calibration process may be performed at intervals, for example every week, or in response to an environmental change, such as a (greater than threshold) temperature change and/or in response to a change in operating parameter(s) of the system, for example a change in power supply voltage. In the case of temperature, a temperature sensor may be incorporated into the display system or product (for example electronic document reading device) and, in embodiments, a set of different display compensation data (k values) may be stored, one for each of a plurality of different temperature ranges.

When measuring the voltage induced on the common pixel electrode, preferably a very high impedance buffer is employed, as previously described. Preferably the circuitry used to measure the change in voltage on the common pixel electrode (gate kickback voltage) is shared with that measuring the output voltage of the voltage compensation driver circuit, for increased accuracy—i.e. using the same "voltmeter" for both. Thus, in embodiments, a common ADC is employed. Preferably the common pixel electrode is coupled to a switch having three settings, one connecting the common pixel electrode to the voltage compensation driver circuit, one connecting this to the measurement circuitry (more particularly, the high input impedance buffer, and one in which the common pixel electrode is substantially disconnected, to reduce charge leakage.

The skilled person will appreciate that references in the above description to a switch are generally to a controllable electronic switch, for example implemented using MOSFET devices.

Again these techniques are particularly advantageous for electrophoretic displays (in which small voltage errors have a cumulative effect over time) on a "plastic electronics" backplane (where the parasitic capacitive coupling can be high, for example inducing a voltage on the common pixel electrode of order 10 volts).

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Figure 1A:
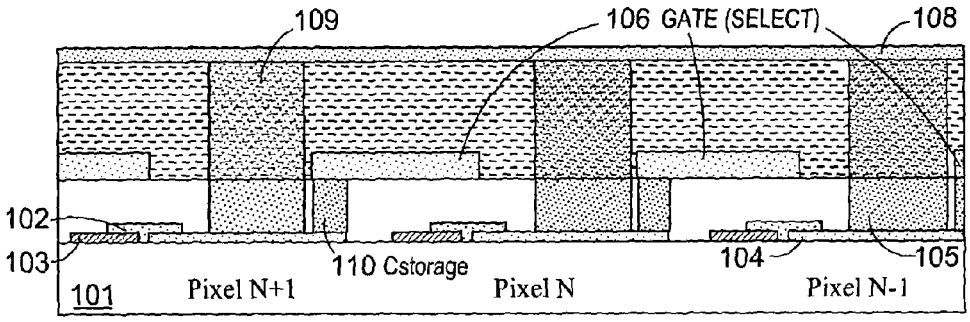
FIGS. 1*a* to 1*d* show, respectively, first and second orthogonal side views of a portion of a display showing a first example active matrix pixel driver structure including a multi-layer transistor structure and pixel capacitor, a top view of the arrangement of FIGS. 1*a* and 1*b*, and the circuit diagram for the arrangement of FIGS. 1*a* to 1*c;*

The techniques we will describe simplify methods for manufacturing functional multilayer devices on dimensionally unstable substrates, in particular manufacturing of electronic display devices on flexible, plastic substrates.

Active matrix displays, where the pixel voltage or current is controlled by one or more thin film field effect transistors, dominate electronic display design. In, say, a top-gate transistor TFT (either a top-gate or a bottom-gate configuration may be employed) the gate electrode needs to overlap with the semiconducting channel and the overlap regions between the gate electrode and the source and drain electrodes determine the parasitic gate-source and gate-drain overlap capacitance $C_{gs}$ and $C_{gd}$, respectively. These should generally be as small as possible to improve the switching speed of the TFTs and minimize unwanted capacitive coupling effects. In an active matrix display $C_{gs}$ is particularly important as it determines the capacitive coupling between the signals running along the gate lines and the pixel electrode. When the gate voltage is switched to turn off the TFT at the end of a particular addressing (pixel charging) cycle Cgs causes the voltage on the pixel to tend to follow the switching of the gate voltage. This so-called kickback voltage changes the pixel voltage from the intended value to which the pixel had been charged with the signal on the data line. This problem with parasitic capacitance becomes important when $C_{gs}$ is large and the problem is particularly acute with flexible substrates, such as plastic substrates because plastic substrates exhibit significant dimensional changes when subject to mechanical stress or temperature variations both of which occur during any manufacturing process. Further, by comparison with structures on silicon or glass, thin film transistors (TFTs) on a plastic substrate tend to be physically larger and to thus exhibit a larger capacitance.

A pixel capacitor can be used to reduce the effect of the parasitic overlap capacitance as the kickback voltage induced on the pixel electrode by the switching gate voltage is smaller the larger the capacitance of the pixel electrode is.

The display medium itself has a capacitance so that a pixel capacitor may comprise capacitance between a pixel electrode (source or drain electrode of a pixel drive TFT) and a pixel capacitor counter electrode, which may simply comprise a common electrode extending over a (front) surface of the display (the backplane being on the display rear surface). Thus in embodiments the common electrode may be a substantially transparent electrode on the viewing surface side of the display. Additionally or alternatively a pixel capacitor can be incorporated by arranging a portion of the pixel electrode to overlap with the gate electrode of the n−1 th gate interconnect line which is at ground potential when the pixel TFTs in the n-th row are being addressed. Alternatively, a separate bus line can be defined at the gate level to overlap with the pixel capacitor portion of the pixel electrode on the source-drain level. We have previously described, in WO 2006/059162, how the shape of the pixel capacitor portion of the pixel electrode can be defined such that the value of the pixel capacitor is independent of the position of the gate/bus line. Despite this, it is useful to have techniques to compensate for the effects of the kickback voltage.

In an active matrix display pixel the pixel capacitor is formed between each of the pixel electrodes and a (common) interconnect line at a fixed potential (Vcom). The interconnect line can be a separate metallic line held at a fixed potential (usually ground potential) during the addressing of the active matrix, or it can be the (N−1)th or (N+1)th neighbouring TFT gate addressing line, that is kept at a fixed potential while the Nth gate addressing line is being addressed. This configuration is preferred because it does not require a third additional set of interconnect lines running across the display, as would be the case where there is a separate bus line.

Figure 1B:
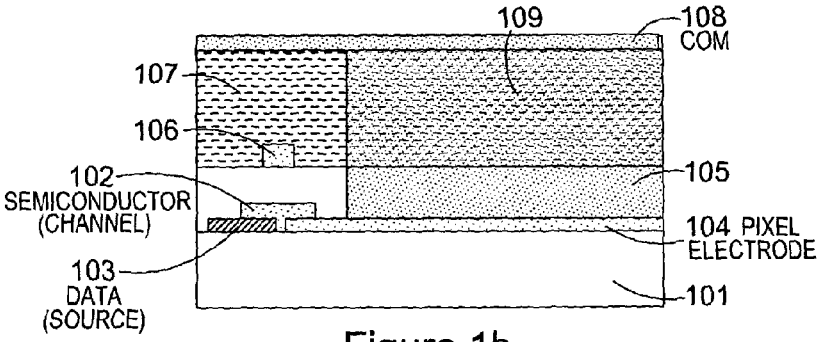
Figure 1C:
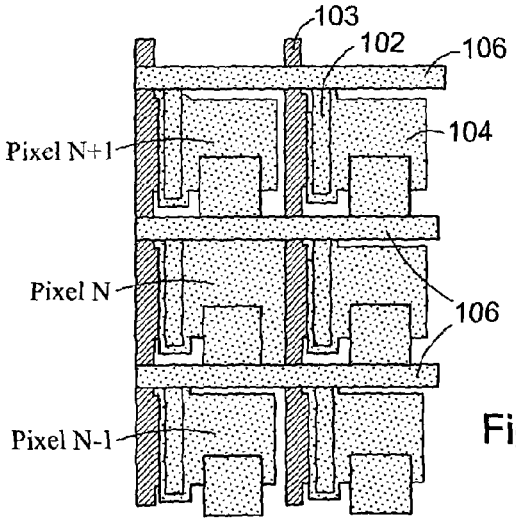

FIGS. 1*a* to 1*d*, which are taken from WO2004/070466, show an active matrix pixel where the display media is voltage controlled, such as liquid crystal or electronic paper. FIGS. 1*a* and 1*b* are orthogonal side views of a transistor-controlled display device including a pixel capacitor. This has a substrate 101, a semiconductor 102, which may be a continuous layer or may be patterned, (in FIG. 1, the semiconductor is patterned in order to cover the transistor channel), a data line 103, a pixel electrode 104, a transistor dielectric 105, a gate electrode/gate interconnect 106 and a display media 107 (for example liquid crystal or electronic paper) and a counter electrode 108 of the display media. In such a system the state of the display media is determined by the electric field across the media, which is a function of the voltage difference between the pixel electrode 104 and the common or counter-electrode 108 of the display medium (COM). A switchable area of the device 109 can be switched by a voltage difference between the pixel 104 and the top electrode 108. This area determines the aperture ratio of the device. FIG. 1*c* is a top view of the device and shows six transistors and six pixels arranged in three rows.

In an active matrix array, the lines are written sequentially. In order to maintain an image, the voltage written to one line should remain relatively constant during the addressing of the other lines. This is particularly true of greyscale devices. In voltage controlled devices such as liquid crystal or electronic paper, the pixel acts as a parallel plate capacitor providing a reservoir of charge. This capacitance can be augmented by the inclusion of a storage capacitor. A storage capacitor (Cstorage, enhancing the storage capacity of the pixel) can be formed by overlapping the pixel with the gate line of the neighbouring transistor. FIG. 1 shows a case where the drain electrode is the pixel electrode, and is a schematic diagram of three adjacent pixels, N=1, N and N+1 of a top gate device. The gate/gate interconnects 106 are extended to overlap part of the adjacent pixel. A capacitor 110 is formed between pixel N and the gate of pixel N−1. The resultant storage capacitor helps the pixel to maintain a constant voltage throughout the cycle. However, in this case, this overlap of the adjacent gate interconnect over the lower, drain (pixel) electrode leads to a reduction of the switchable area 109 of the device and therefore, the aperture ratio.

Figure 1D:
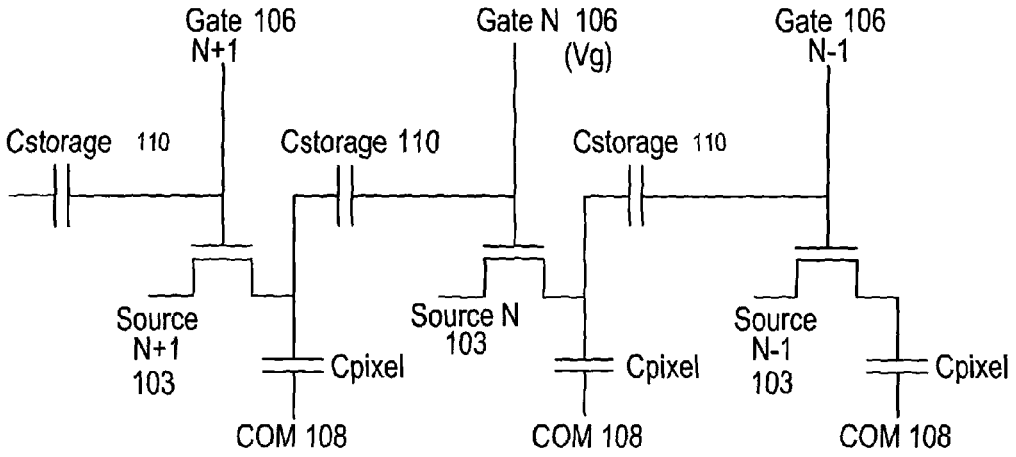

FIG. 1*d* shows the circuit diagram for this arrangement, where the storage capacitor, $C_{storage}$, is formed between the pixel electrode 104 and the gate of a pixel of a neighbouring transistor. This capacitor acts as a reservoir for charge and therefore enhances the image holding ability of the pixel.

Pixel capacitors are particularly important when used in conjunction with thicker display media such as electronic paper where the thickness of the display effect, such as an electrophoretic media, leads to a lower capacitance of the display element itself. In these displays the pixel capacitor can take up a significant fraction of the pixel, especially where the kickback effect is large.

In our patent application WO2006/106365 a four or five layer architecture structure is disclosed where the pixel capacitor can be formed with one of the two electrodes of a pixel capacitor being quasi-continuous. In such a case, the pixel capacitance becomes largely insensitive to the detailed position of the other of the electrode. This can be achieved, for example, by running a straight common electrode (COM) line with a given line width smaller than the pixel pitch behind the pixel electrode. By choosing an appropriately thick dielectric between the COM line and the TFT layers a contribution to the pixel capacitance from overlap of the COM line with the drain electrode of the TFT in the first layer can be small, which leads to a uniform value of the pixel capacitance across the pixel array, important for grey scale displays.

In our patent application WO/2009/133388 we have described how an off-set pixel electrode can be used to achieve increased storage capacitance: In such an off-set configuration the top pixel electrode is deposited to overlap the first capacitor plate (COM electrode) of one device and also the gate electrode of a neighbouring device.

Figure 2A:
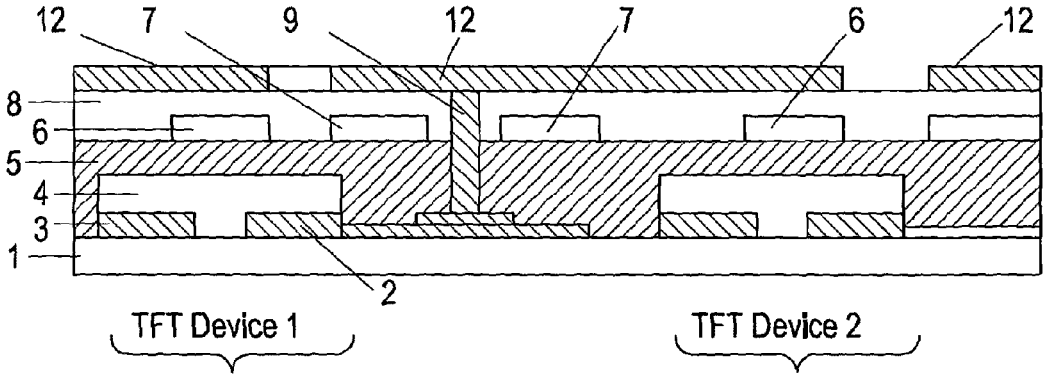
FIGS. 2*a* and 2*b* show, respectively, a vertical cross-section (along a staggered line) through a portion of an active matrix backplane showing a second example active matrix pixel driver circuit including a multi-layer transistor structure and pixel capacitor, with an off-set the top pixel electrode configuration for reduced kickback, and the structure of FIG. 2*a* from above.
Figure 2B:
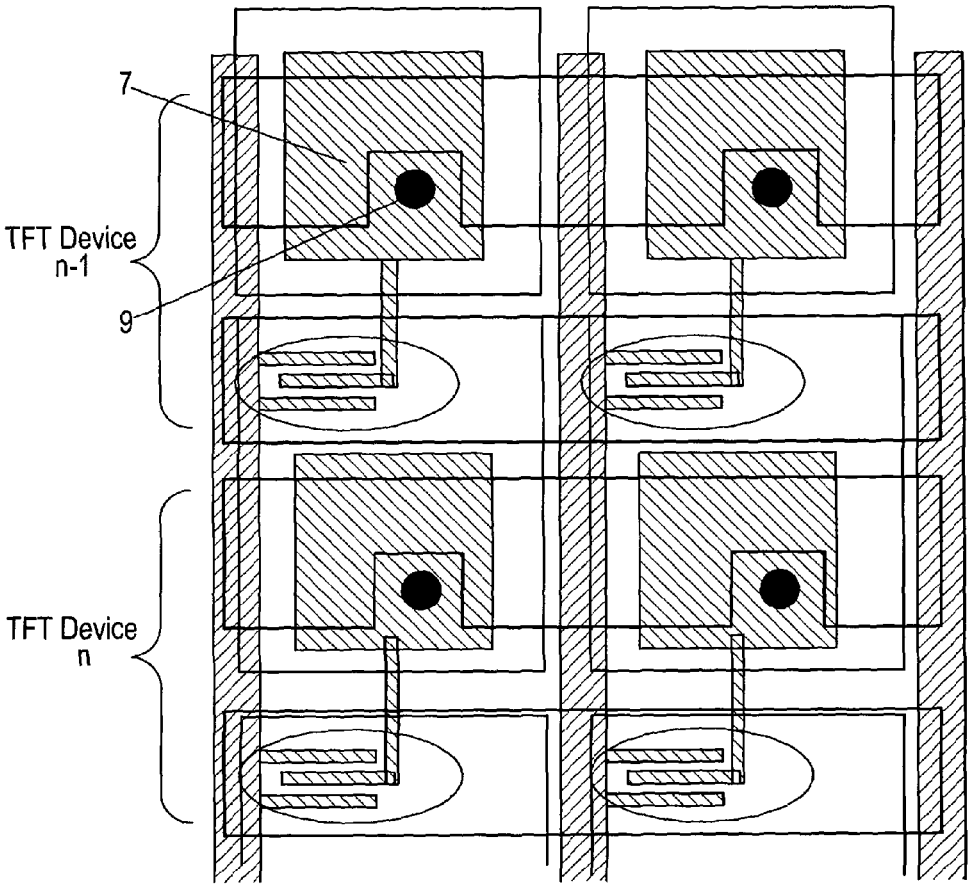

Referring to FIG. 2*a*, this shows a vertical cross-section (along a staggered line) through an example of such an active matrix backplane structure. In FIG. 2*a* a substrate 1 bears a thin film transistor (TFT) device comprising source and drain electrodes 2, 3, a layer of semiconducting material 4, a gate dielectric 5 and a gate electrode/interconnect 6. A COM electrode 7 is formed in the same later as gate electrode 6. An upper dielectric 8 overlies the gate and COM electrodes and a top pixel electrode 12 is provided over dielectric layer 8, connected to one of the source/drain electrodes by a via 9. FIG. 2*b* shows the structure from above, illustrating that the COM electrode is patterned to provide a non-conducting cut-away for via 9. The top pixel electrode overlaps with the COM electrode (Cn) 7 of the first device (Device 1) and the gate electrode (Gn+1) 13 of the neighbouring device (Device 2).

Storage capacitance $C_{storage}$ is obtained from an overlap between the COM electrode and the drain electrode. The effect of an off-set top pixel electrode is an increase in overall storage capacitance caused by an overlap between the top pixel electrode and the COM electrode as well as between the top pixel electrode and the gate ($G_{n-1}$). The parasitic capacitance between the gate electrode and the drain electrode remains unchanged but the parasitic capacitance between the top pixel electrode and the gate electrode decreases and thus the storage capacitance ($C_{storage}$) may be increased by lowering the top pixel dielectric thickness. This increases the overall $C_{storage}/C_{Parasitic}$ capacitance ratio, thus increasing overall pixel capacitance and reducing kickback voltage and variation. The top pixel dielectric layer may be tuned to maximise $C_{storage}$, without increasing $C_{parasitic}$.

Figure 3:
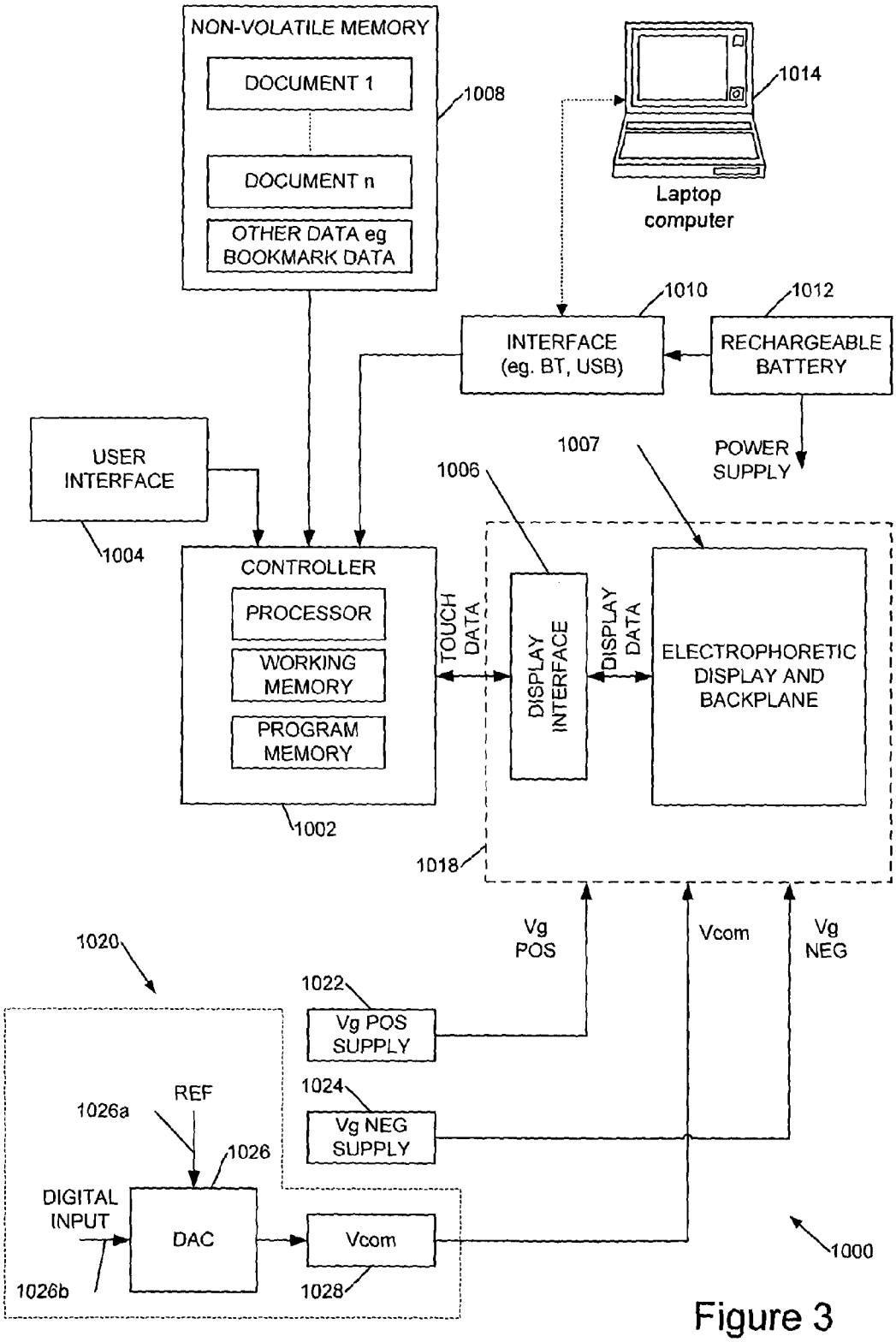
FIG. 3 shows a block diagram of an electronic document reader including a gate kickback control system.

Referring next to FIG. 3, shows a block diagram of an electronic document reader 1000 including a first example gate kickback voltage adjustment system 1020.

The electronic document reader 1000 comprises a controller 1002 including a processor, working memory and programme memory, coupled to a user interface 1004. The controller 1002 is also coupled to an active matrix backplane and electrophoretic display 1007 by a display interface 1006, to send electronic document data to the display and, optionally, to receive touch-sense data from the display (where a touch sensor is provided for the display). The control electronics also includes non-volatile memory 1008, for example Flash memory, for storing data for one or more documents for display and, optionally, other data such as user bookmark locations and the like. An external wired or wireless interface 1010, for example USB and/or Bluetooth™, is provided for interfacing with a computer such as a laptop 1014, PDA, or mobile or 'smart' phone to receive document data and, optionally, to provide data such as user bookmark data. A rechargeable battery 1012 or other rechargeable power source is connected to interface 1010 for recharging, and provides a power supply to the control electronics and display.

The power supply to the display/interface system 1018 (shown enclosed by a dashed line) includes positive and negative gate voltage supplies Vg POS, Vg NEG and a Common Voltage supply Vcom. In FIG. 3 Vg POS and Vg NEG are provided by respective gate voltage power supplies 1022, 1024. In embodiments the difference between Vg POS and Vg NEG, Vgswing, can be relatively large, for example ~70 volts. The gate kickback voltage adjustment system 1020 comprises a digital-to-analogue converter (DAC) 1026 with an output driving a buffer 1028 which in turn provides voltage Vcom to display/interface system 1018. The DAC 1026 has a digital input 1026*b*, for example from controller 1002, and a reference input 1026*a* and is configured to generate an output voltage which depends on the digital input value scaled by a signal level (voltage) on the reference input 1026*a*.

The digital input may be set by controller 1002 at an approximately correct value and then adjusted by adjusting the voltage (or current) on the reference input 1026*a*. In some embodiments this adjustment may be calculated (as described further below) or, alternatively, it may be set at manufacture (of the display or e-reader), by adjusting one or both of the digital input value and the reference level to optimise the visual appearance of the display or to minimise (or null) a measured gate kickback voltage. In embodiments the value of the digital input and/or reference determined in this way may be stored in the non-volatile memory 1008. In an example embodiment the DAC reference level was ~1 volt and the value of Vcom was ~10.5 volts.

Figure 4:
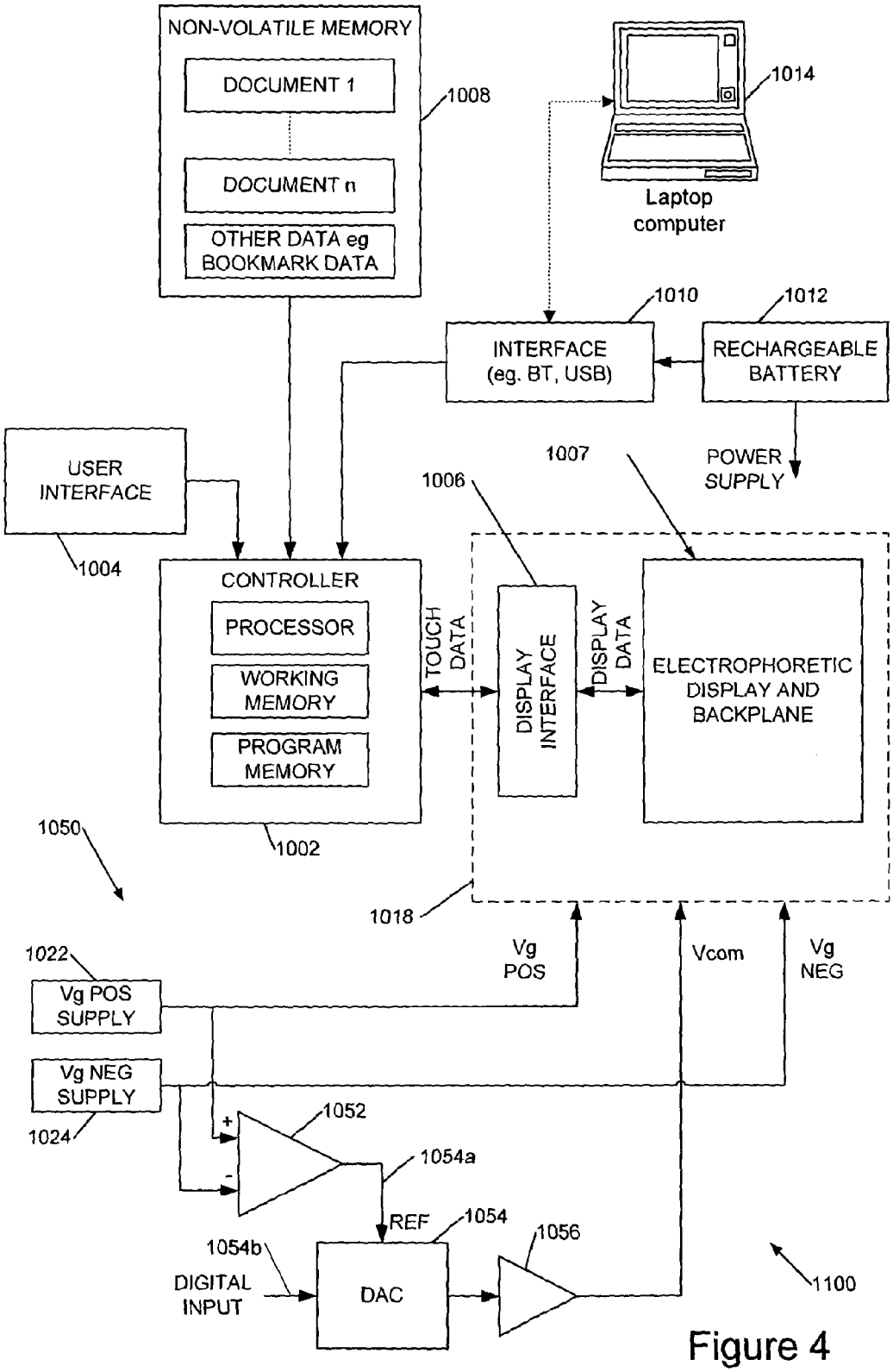
FIG. 4 shows a block diagram of an electronic document reader including an automatic gate kickback control circuit.

FIG. 4 shows a block diagram of an electronic document reader 1100 including an automatic gate kickback control circuit 1050 (like elements to those of FIG. 3 are indicated by like reference numerals).

In FIG. 4 the gate kickback control circuit 1050 is used to automatically adjust the voltage on the counterelectrode of the pixel capacitor of the display, by defining a relationship between this common voltage and the positive and negative gate voltages. The "error" in the common voltage is defined as a function of the positive and negative gate bias voltages, in embodiments a proportion of the difference between these two voltages. Thus in embodiments the kickback voltage $V_{kb}$, and hence common voltage Vcom is determined by:

$$V_{kb}=V\text{com}=K\times(|V\text{g}\text{POS}|-|V\text{g}\text{NEG}|)$$

where K is a constant of proportionality. (The contribution of channel charge to $V_{kb}$ is not included in the above equation). With, say, a reference level of 1 volt and a difference between positive and negative gate voltages of order 1 volt (which may occur with, say, a gate voltage swing of 70 volts), the adjustment to the reference voltage may be of order 1/70 volts. (It should be noted, however, that constant of proportionality K is a parameter of the display and is not dependent on the gate swing). In the kickback control circuit 1050 a differential or error amplifier 1052 receives inputs from the positive and negative gate voltage supplies and provides a reference level output 1054*a* to a digital-to-analogue converter 1054. The DAC 1054 has a digital input 1054*b*, for example from controller 1002, to set an approximately correct value of Vcom, and this value is then automatically adjusted by control of the reference level input to DAC 1054 (which acts as a form of multiplier) so that the value of Vcom changes slightly with the gate voltage swing.

The DAC 1054 provides a voltage output to an amplifier/driver 1056 which provides a voltage output for the Vcom connection to the display/interface system 1018. In this way the common voltage is automatically compensated for kickback arising from parasitic capacitance within the display/interface system 1018, by correcting the common voltage as a function of the difference between the on-and-off pixel states of the display. The skilled person will appreciate that this approach can be used with a range of (column) driver chips for driving an electrophoretic display (in general the positive and negative and gate bias voltages being provided as power supplies to one or more gate driver integrated circuits.

Improved Techniques

Figure 5:
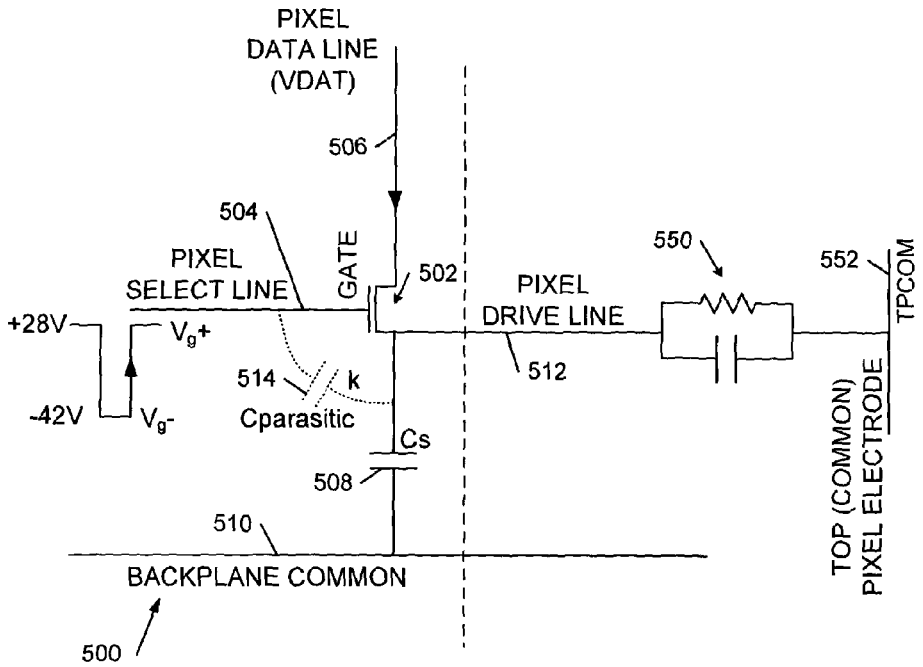
FIG. 5 shows a further example of a pixel driver circuit on a flexible plastic backplane, in combination with a pixel of an electrophoretic display.

Referring now to FIG. 5, this shows a further example of a pixel driver circuit 500 fabricated using solution deposition techniques on a flexible plastic backplane, in combination with a pixel 550 of an electrophoretic display. In FIG. 5 the portion to the right hand of the dashed line constitutes the electrophoretic display and the portion to the left side of the dashed line, the active matrix backplane; these are sandwiched together to make an active matrix display.

The pixel driver circuit of FIG. 5 comprises a thin film transistor 502 having a gate connection 504 which is connected to a pixel select line of the display. When activated a voltage on pixel data (VDAT) line 506 is coupled to one plate of storage capacitor Cs 508, the other plate of which is connected to a backplane common connection 510. The junction between transistor 502 and storage capacitor 508 also provides a pixel drive line 512 which is connected to the electrophoretic display pixel 550. Pixel 550 may be modelled as a high value resistor, for example of order 800 MΩ, in parallel with a small capacitor, for example less than 1 pF. A second connection of the electrophoretic display pixel is connected to the common or top pixel electrode, TPCOM 552.

In operation, when the pixel select line 504 is activated the voltage on line 506 is applied between the pixel drive line 512 and TPCOM 552, and is also stored on capacitor 508. A typical voltage range for line 506 is between −16 volts (white) and +16 volts (black). FIG. 5 illustrates an example gate drive waveform on the pixel select line going between +28 volts and −42 volts, that is, approximately a 70 volt swing. When the gate voltage returns from its negative value to its positive value, deselecting transistor 502, parasitic capacitance illustrated by capacitor 514 couples a proportion of this voltage to the pixel drive line 512. For organic/solution-deposited devices on a plastic substrate the parasitic capacitance is relatively large and a voltage, of order 10 volts, may be coupled to the pixel drive line. This is a substantial proportion of the black-white voltage range.

When driving an electrophoretic display pixel, because of the relatively slow response of such displays a single pixel may be written to perhaps every 20-30 ms, to maintain a drive to the pixel. In a practical device there may be some leakage due to resistance between the TPCOM plane 552 and one or both of the gate voltage power supplies (this leakage resistance is not shown in FIG. 5). Also, in general, the TPCOM plane 552 will be coupled, at least indirectly to the backplane 510.

The relatively slow update rate of an electrophoretic display indirectly introduces further difficulties: to speed the display update, often only a small region of the display is updated since often, when for example typing, only a small region of the display changes. The remainder of the display is written with a null frame, that is, with a voltage on line 506 of zero volts, which for an electrophoretic display corresponds to no-change in the displayed "colour". However if the voltage actually experienced by the pixel is not zero, there is a gradual drift towards either black or white. The visibility of such drift imposes tight constraints on accurately compensating the gate kickback voltage—for example for a gate kickback voltage of around 10 mV the compensation should preferably be accurate to better than within 50 mV. Referring to the circuitry of FIG. 4, in particular to the amplifier/driver 1056, this may have, in embodiments a ×10 gain. Thus a 2-3 mV input off-set error in this component can effectively use up all of the error tolerance of the system without considering other sources of error, such as errors in feedback resistor values defining the gain of this amplifier. It can therefore be appreciated that, because of the special requirements of electrophoretic displays and plastic backplanes, there are very stringent requirements on the voltage compensation driver circuitry. These problems are exacerbated because the characteristics of the display and the performance of the driver circuitry also depend upon temperature, ageing, humidity and the like.

Initially a display is characterised where it is fabricated, in embodiments by creating a data file for each individual display defining the positive and negative gate drive voltages and the measured kickback voltage, from which the aforementioned parameter k can be calculated (dividing the kickback voltage by gate voltage swing). Then, knowing the gate voltage swing in an actual device application, for example of the display/driver combination in an e-reading device, using the parameter k the ideal gate kickback compensation voltage can be calculated and used to determine a digital input value for input 1054*b* of DAC 1054.

However, in practice, because of the aforementioned errors in offset, gain, component values and the like, the actually applied compensation voltage will be different to that desired. Therefore in embodiments of the system we describe the actually applied compensation voltage is measured and used to adjust the digital value on line 1054*b* so that the actually applied voltage substantially matches that which it has been calculated is desired (preferably matching to within the DAC resolution). The gate voltage swing and applied compensation voltage are preferably measured using the same analogue-to-digital converter, using a multiplexed input, because again small errors can otherwise arise which, in the context of the systems we describe, can cause visual artifacts.

We will now describe in more detail the equations and relationships between display parameters and system voltages to enable accurate setting of the display top-plane COM supply voltage, that is the supply voltage to common pixel electrode 522.

Figure 6:
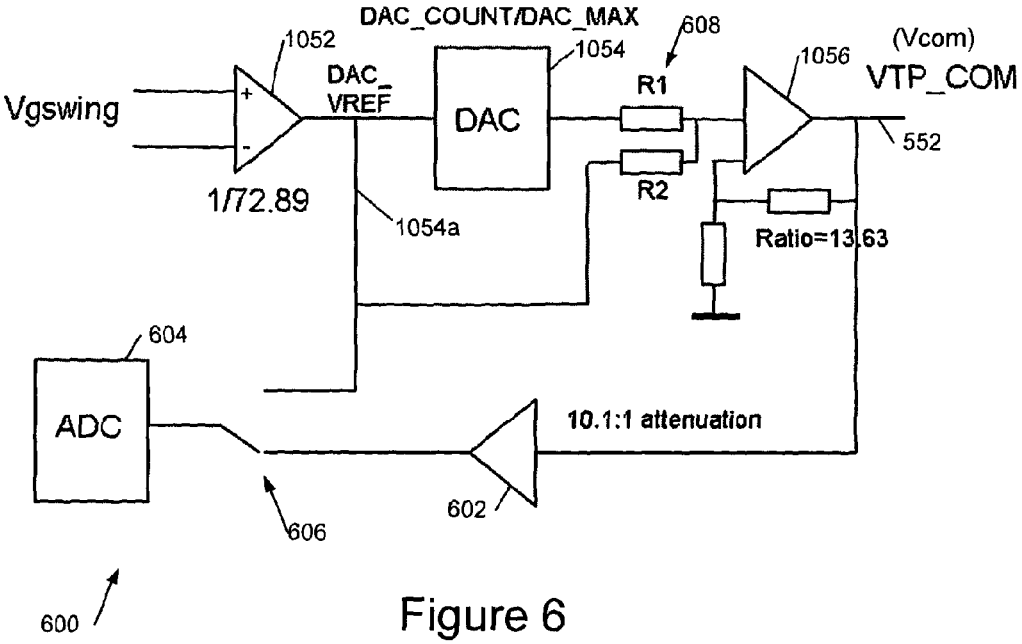
FIG. 6 shows a gate kickback voltage compensation system according to an embodiment of the invention.

We will refer, in particular, to FIG. 6, which shows a gate kickback voltage compensation system 600 according to one embodiment of the invention. In FIG. 6 like elements to those previously described are indicated by like reference numerals. Thus differential amplifier 1052 has a gain of approximately 1/73, to reduce the measured gate voltage swing to approximately 1 volt, for convenience. Similarly amplifier 1056 has a gain of approximately 14, and therefore the circuit includes a 10:1 attenuator 602, again to bring this down to a voltage of order 1 volt.

Additional components in the arrangement of FIG. 6 include an analogue-to-digital converter (ADC) 604 with a switch 606 connected to its analogue input to selectively measure either the reference voltage on line 1054*a* or the gate kickback compensation voltage actually applied to the common pixel electrode, via attenuator 602. (The skilled person will appreciate that the setting of switch 606 is under control of 1002, although this is not explicitly shown in FIG. 6). Thus the arrangement of FIG. 6 is able to measure both the gate voltage swing and the actually applied gate kickback compensation voltage. A further refinement in the circuit of FIG. 6 is the inclusion of a summer 608 comprising resistors R1 and R2, to add a proportion of the reference voltage on line 1054*a* to the analogue output of DAC 1054. This effectively scales up the output of DAC 1054 so that the DAC may have a reduced range/resolution. For example the desired range of kickback compensation voltage may be between 6 volts and 14 volts, that is an 8 volt range, and this may be provided by an 8 bit DAC to an accuracy of about 0.5% (1 in 255). This results in a constant term of 0.75 in the equation for DAC_COUNT given later.

Gate Kickback Voltage Compensation Procedures

We will describe two processes. The first matches the Vkb (Kickback voltage) value from the manufacturer of the display to the HV (high voltage, gate drive) power supplies of the display driver, in particular when installed in a product such as an electronic document reading device. The second process reads back the Vkb measurement from the display, and sets the VCOM power supply to match.

The display Vkb is initially measured at the factory. This is done in a controlled environment. However in the real world where a product is subject to many different environmental conditions (temperature, humidity, ageing, usage and so forth), the display and controlling electronics characteristics change.

Procedure 1

A first procedure uses the relationship between VGswing and Vkb to set VCOM. We use the tracking mechanism described above so that VCOM tracks VGswing, but in this improvement we set the value of VCOM to start with by characterizing the power supply controlling DAC for VCOM for offset and gain errors.

The procedure for VCOM supply gain and offset error cancellation is outlined as follows:

1. Measure the output from the VGswing tracking circuit to give DAC Vref. This is 1V when VGswing is 70V, but if there are errors in the power supplies for VGPOS and VGNEG, the value will be different.
2. Switch the input of the measuring ADC to the output from the VCOM supply Take a reading with the ADC.
3. If the VCOM power supply has no gain or offset errors then the measurement in step 2 should be equal to DAC Vref multiplied by the ideal gain of the VCOM amplifier and the DAC count. By comparing the ideal value of VCOM with that measured in step 2, software on controller 1002 iteratively adjusts the DAC count until the measured value of VCOM is correct for the measured value of DAC Vref. It can be shown (see below) that for example component values used in the VCOM supply circuit described, the DAC count is related to the display's "k" parameter and the DAC maximum count by:

$$DAC_COUNT=INT(DAC_MAX(k\times 8.7152-0.75))$$

Gate Kickback Voltage Compensation Equations

As previously described, the purpose of the top-plane COM supply is to cancel the effect of charge induced in the display pixel electrodes due to coupling of the TFT gate signals through the parasitic capacitances present (gate-drain) and other mechanisms, that is "kickback". The top-plane COM supply is required to source and sink current and is implemented using an amplifier with its output ideally set to a voltage equal to the display kickback voltage.

We here employ symbols as follows:

VTP_COM: Display top-plane COM supply voltage
VGPOS: Display gate power supply positive voltage
VGNEG: Display gate power supply negative voltage
VDAC: Top-plane voltage D-to-A converter output voltage. Input to top-plane COM amplifier
DAC_VREF: Top-plane D-A converter reference voltage
DAC_COUNT: digital input setting for the DAC
DAC_MAX: maximum input count to the DAC
ACOM: Top-plane COM amplifier voltage gain
Vkb: The display kickback voltage
k: Display kickback voltage ratio, the ratio of Vkb to (VGPOS-VGNEG)
VGSWING: the display gate signal voltage swing, equal to (VGPOS-VGNEG)

The general form of equation which relates VTP_COM to VGSWING is:

$$VTP_{COM} = \frac{VGSWING}{c}(m + A)$$

where m is a function of
DAC_COUNT/DAC_MAX
The COM amplifier gain, ACOM
Display kick back ratio, k
c is the fraction of gate swing used for the DAC reference voltage
A is derived from
The COM amplifier gain, ACOM The term A provides a VGSWING dependent offset which reduces the span required for the DAC and improves setting resolution.

Kickback Ratio

For each display the kickback ratio, k, is calculated during manufacture using measured values of Vkb, VGPOS and VGNEG. The kickback ratio is defined as:

$$k = \frac{Vkb}{VGPOS - VGNEG} \quad (1)$$

$$k = \frac{Vkb}{VGSWING} \quad (2)$$

For example displays, k lies in the range 0.12 to 0.19.

For correct display operation the top-plane COM voltage should be set to be equal to Vkb. In production electronics VGPOS and VGNEG will generally vary from unit to unit so the kickback ratio is used to enable the correct top-plane COM voltage to be set on per-unit basis. The value is used by the top-plane COM voltage-setting software to modify DAC_COUNT to account for display-to-display variations in Vkb.

VGSWING and DAC_VREF

In embodiments of the system, VGSWING is measured and the result is used to provide the reference voltage for the DAC. VGSWING is typically of the order of 70V. To make the voltage useable as a DAC reference it is attenuated by a factor of 72.89. The DAC reference voltage is thus given by:

$$DAC_{VREF} = \frac{VGSWING}{72.89} \quad (3)$$

VTP_COM

The top-plane COM amplifier output has an offset added to a variable element controlled by the DAC. The offset reduces the span required of the DAC and improves the setting resolution. For correct operation of the VTP_COM vs. VGSWING tracking requirement, the offset should track VGSWING.

For ideal operation the display top-plane COM voltage should be set equal to the kickback voltage:

$$VTP_{COM}=Vkb \quad (4)$$

In an example implementation we require VTP_COM minimum=6V, and maximum=14V. The adjustment span is thus 8V. In FIG. 6, the Vgswing dependent offset is supplied by R2 and the DAC count dependent part is supplied by R1. The ratio of R2 to R1 is the ratio of VTP_COM span to VTP_COM span offset i.e.

$$R2/R1=8/6=4/3$$

When DAC_COUNT is maximum, we require VTP_COM to be 14V. The voltage at the summing node of R1 and R2 will be $$\frac{VGSWING}{72.89} = 0.96V$$

for VGSWING=70V.

In this example the required ACOM is thus 14/0.96=14.58

The equation for VTP_COM is thus:

$$VTP_{COM} = \frac{VGSWING}{72.89} \times ACOM \times \left(\left(\frac{DAC_{COUNT}}{DAC_{MAX}} \times \frac{4}{7}\right) + \frac{3}{7}\right) \quad (5)$$

Obtaining DAC_COUNT from the Kickback Ratio k

From equation (2)

$$VTP_{COM}=k\times VGSWING \quad (7)$$

Substituting into (6) and rearranging gives:

$$DAC_{COUNT} = \mathrm{INT}\left(\mathrm{MAX}_{DAC} \times \frac{7}{4}\left(\frac{VTP_{COM} \times 72.89}{ACOM \times VGSWING} - \frac{3}{7}\right)\right) \quad (8)$$

Inserting numerical value for ACOM and substituting k for VTP_COM/VGSWING:

$$DAC_{COUNT} = \mathrm{INT}\left(\mathrm{MAX}_{DAC} \times \frac{7}{4}\left(\frac{k \times 72.89}{14.63} - \frac{3}{7}\right)\right) \quad (9)$$

Taking 7/4 inside the brackets, equation 9 further simplifies to:

$$\mathrm{DAC_COUNT} = \mathrm{INT}(\mathrm{DAC_MAX}(k \times 8.7152 - 0.75)) \quad (10)$$

VTP_COM Calibration

In FIG. 6 the 10:1 attenuator and switch are used for VTP_COM calibration. The aim is to substantially eliminate the effects of DAC and COM amplifier offset and gain errors. The system uses an ADC as a voltmeter to measure VTP_COM and compare it with its ideal value, and then correct for any errors due to the DAC and COM amplifier.

VTP_COM Calibration Procedure

An example VTP_COM calibration procedure in this embodiment is as follows:

1) Set top-plane COM switch to open
2) Turn HV (the high voltage gate supply) on
3) Set the ADC input switch to measure DAC_VREF
4) Set VTP_COM to its nominal value using the DAC_COUNT value obtained from equation 10.
5) Measure DAC_VREF via the ADC
6) Set the ADC input switch to measure VTP_COM via the 10.1:1 attenuator
7) Calculate VTP_COM=10×ADC measured value
8) Compare the calculated value for VTP_COM with the ideal value obtained from:

$$VTP_{COM(ideal)} = k \times 72.89 \times DAC_{VREF}$$

where DAC_VREF is the value measured in step 4

9) Calculate the correction needed to DAC_COUNT so that VTP_COM becomes equal VTP_COM(ideal)
10) Set DAC_COUNT to this value.
11) Store the value of DAC count An enhancement to the VTP_COM calibration procedure allows operation with any practical value of R1 and R2 and hence A and ACOM. The key advantage of the enhancement is that the controller no longer requires any knowledge of the values of R1, R2, A and ACOM.

The offset ($V_{OFFSET}$) and span ($V_{SPAN}$) of the COM amplifier output are measured.

Equation (10) then becomes:

$$VCOM_{IDEAL} = (k \times 72.89 \times DAC_{VREF} - V_{OFFSET})/V_{SPAN}$$

$$DAC_{COUNT} = \mathrm{INT}(\mathrm{MAX}_{DAC}(VCOM_{IDEAL}))$$

where $VCOM_{IDEAL}$ is the deal operation voltage for the common pixel electrode, as described earlier, $V_{OFFSET}$ is the minimum voltage that may be applied to the common pixel electrode as measured by the ADC (such that $V_{OFFSET} = VCOM_{MEASURE}(\min)$) and $V_{SPAN}$ is the difference between the maximum and minimum voltages that may be applied to the common pixel electrode as measured by the ADC (such that $V_{SPAN} = VCOM_{MEASURE}(\max) - VCOM_{MEASURE}(\min)$).

The above equation is used to calculate the initial DAC_COUNT.

In practice, further correction to DAC_COUNT typically be required due to system gain and offset errors.

The correction procedure is as follows:

The COM voltage obtained due to DAC_COUNT is measured ($VCOM_{MEASURE}$).

$$ERROR_{PROPORTION} = (VCOM_{IDEAL} - VCOM_{MEASURE})/V_{SPAN}$$

$$ERROR_{DACCOUNT} = \mathrm{MAX}_{DAC}(ERROR_{PROPORTION})$$

$$DAC_{COUNT} = DAC_{COUNT} + ERROR_{DACCOUNT}$$

The correction procedure repeats until the absolute magnitude of $ERROR_{DACCOUNT}$ is less than the resolution of the DAC.

Procedure 2

A second procedure is then used during the lifespan of the display to track drift in the "k" parameter. To achieve this, in embodiments controller 1002 and associated hardware are employed to measure the display kickback voltage with the display in-situ. The aim of the VCOM calibration process is to set VCOM to be equal to Vkb (measured).

Employing a closed loop measurement mechanism in the display/driver system allows the effects of environmental conditions to be taken into account and, in embodiments, a close-to ideal VCOM voltage can be set for the display. Optimal performance and reliability of the display may therefore be maintained.

In one embodiment, to perform this second VCOM calibration process the following steps are performed:

1. Write X no. of null frames to the display; for example in one implementation X=50.
2. During this time set the analogue switch to connect VCOM from the display to the input of the measuring ADC. (This disconnects the Vcom amp from the display).
3. Take multiple readings on the ADC and average them. This is Vkb measured value.
4. Set the analogue switch to the output of the VCOM power supply and take a reading on the ADC. Note that this is the same ADC as used in Step 3, so any error in the ADC will be the same for both measurements and will cancel.
5. Once the reading has been taken, adjust the VCOM DAC so that VCOM has the same value as the measured Vkb.

The second process can be run at any time, for example after a given time has elapsed and/or when the system detects a significant change in ambient temperature, to thus maintain an optimum setting for VCOM and hence image quality.

Hardware Implementation

Figure 7:
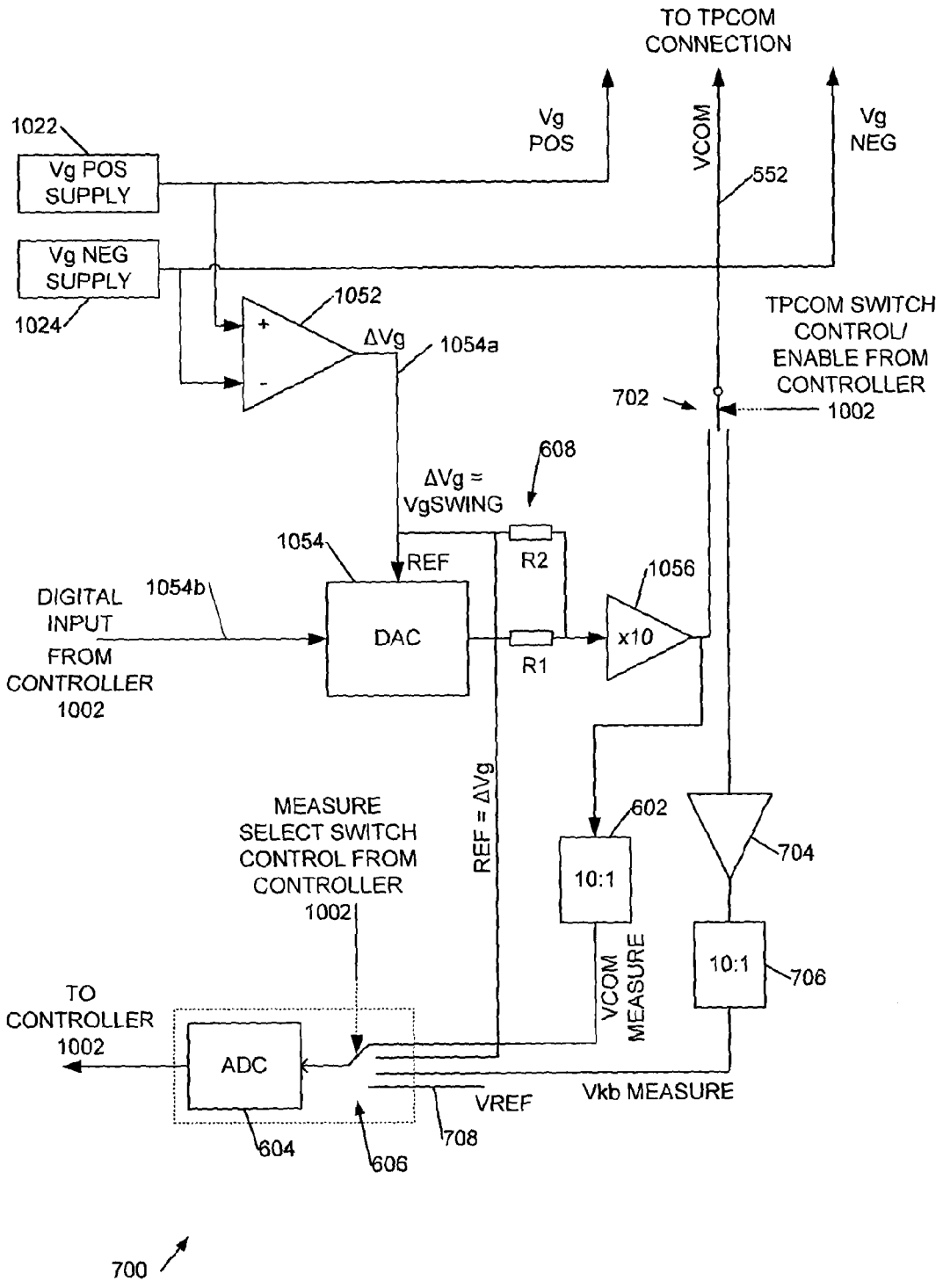
FIG. 7 shows a portion of the electronic document reader of FIG. 4 including an induced voltage compensation circuit configured to implement gate kickback voltage compensation procedures accordance with embodiments of the invention.

Referring now to FIG. 7, this shows a portion of the electronic document reader of FIG. 4 including an induced voltage compensation circuit 700 configured to implement the first and second procedures described above in accordance with embodiments of the invention. Like elements to those previously described are indicated by like reference numerals.

Thus, referring to FIG. 7, a common pixel electrode switch 702 has three states, one in which the output of amplifier/driver 1056 is connected to drive the common pixel electrode, the second in which the common pixel electrode 552 is connected to the input of a high impedance buffer 704, and a third state in which the switch 702 is disabled so that it is in a high impedance state (illustrated) thus effectively disconnecting the common pixel electrode 552 from potential leakage paths.

Buffer 704 preferably has input impedance of order 100MΩ and, in embodiments, a 10:1 attenuation block 706 follows the buffer to bring the measured voltage, that is the measured gate kickback voltage, into a suitable range for input to ADC 604. Attenuator block 706 may be implemented, for example, by high tolerance matched resistors (for example 0.01% tolerance in ratio). Likewise, as previously described, differential amplifier 1052 may have a gain of approximately 1/73 to scale the gate swing before input to the ADC. As previously described ADC 604 has an input multiplex switch 606, controlled by controller 1002, so that the controller 1002 may measure either the gate voltage swing, or the applied gate kickback compensation voltage, or the actual induced gate kickback voltage. In embodiments an optional further input 708 on the switch may be employed to provide a high accuracy external voltage reference input to ADC 604, to enable measurements to be compared with this, for increased measurement accuracy. The ADC 604 may have, for example, 10 bits.

In operation the system of FIG. 7 may measure the induced gate kickback voltage over a period of order one second (50 frames, 20 ms per frame) for increased accuracy. As previously described, optionally a temperature sensor may be included and either or both of the above described calibration procedures implemented according to whether the temperature is in one of a set of temperature ranges and/or following a greater than threshold level temperature change.

As illustrated in FIG. 7, in preferred embodiments a single ADC 604 is used for measuring the gate voltage swing, the induced kickback voltage, and the gate kickback compensation voltage again for increased accuracy.

Many variations on the above described techniques are possible. For example the display could be subdivided into regions and the above described techniques applied separately to different regions of the display, for example if gate-source capacitance and/or the gate kickback effect vary across the area of a display.

No doubt many other effective alternatives will occur to the skilled person. It will be understood that the invention is not limited to the described embodiments and encompasses modifications apparent to those skilled in the art lying within the spirit and scope of the claims appended hereto.

What is claimed is:

1. A display system comprising an electrooptic display coupled to a display driver, the electrooptic display comprising a plurality of pixels each with a pixel drive electrode driven by a pixel driver circuit, said plurality of pixels sharing a common pixel electrode, said pixel driver circuits each comprising a pixel select line to select the pixel, a pixel data line to receive pixel data for driving the pixel, and a pixel drive line coupled to said pixel drive electrode to drive said pixel drive electrode with a signal dependent on said pixel data, said display driver including an induced voltage compensation circuit to compensate for an induced voltage comprising a voltage induced on said pixel drive electrode by a changing voltage on said pixel select line, the induced voltage compensation circuit comprising:

a system comprising an analogue-to-digital converter configured to act as a voltmeter to:

measure a voltage applied to said common pixel electrode; and measure a change in voltage on said common pixel electrode due to said voltage induced on said pixel drive electrode; and a system to apply a compensation voltage to said common pixel electrode, responsive to a combination of said measured applied voltage and said measured change in voltage, to compensate for said induced voltage, wherein said system to apply a compensation voltage comprises a digital-to-analogue converter having a digital input, a reference voltage input, and an analogue voltage output;

wherein said system to apply a compensation voltage is configured to determine an ideal operation voltage for said common pixel electrode dependent upon a combination of:

said reference voltage input of said digital-to-analogue converter;

a voltage offset, wherein said voltage offset is a minimum voltage applied to said common pixel electrode as measured by said analogue-to-digital converter; and a voltage span, wherein said voltage span is a difference between a maximum voltage applied to said common pixel electrode as measured by said analogue-to-digital converter and said minimum voltage; and wherein said system to apply a compensation voltage is configured to determine said compensation voltage to be applied to said common pixel electrode responsive to said ideal operation voltage.

2. A display system as claimed in claim 1 wherein said electrooptic display comprises an electrophoretic display mounted on a plastic backplane comprising said pixel driver circuits.

3. A display system as claimed in claim 1, further configured to perform a procedure to determine an error in a voltage on said digital input of said digital-to-analogue converter used to set said applied voltage, wherein said error is a function of said maximum digital input value of said digital-to-analogue converter and is dependent upon:

said ideal operation voltage of said common pixel electrode, said measured voltage applied to said common pixel electrode, and said voltage span of said digital-to-analogue converter.

4. A display system as claimed in claim 1, wherein said reference voltage input is configured to receive a signal dependent on a voltage swing on said pixel select line, wherein said digital input of said digital-to-analogue converter is configured to receive a digital value for said compensation voltage to be applied.

5. A display system as claimed in claim 4 further comprising a summing circuit having inputs coupled to said analogue output of said digital-to-analogue converter and to a signal dependent on said voltage swing, and an output for driving said common pixel electrode, such that said analogue output of said digital-to-analogue converter is offset by a scaled version of said voltage swing.

6. A display system as claimed in claim 1 further comprising a system to measure a voltage swing on said pixel select line, and non-volatile memory storing display compensation data defining a relationship between said voltage swing on said pixel select line and said induced voltage on said pixel device electrode, and wherein said system to apply a compensation voltage to said common pixel electrode is configured to adjust said voltage applied to said common pixel electrode to bring said measured applied voltage towards a compensation voltage determined from said display compensation data and said measured voltage swing.

7. A display system as claimed in claim 6, further comprising a system to measure said voltage swing on said pixel select line and wherein said analogue-to-digital converter has an analogue input coupled to a measure select switch to switch said analogue input between a voltage dependent on said voltage swing and a voltage dependent on said voltage applied to said common pixel electrode.

8. A display system as claimed in claim 1 wherein said system to apply a compensation voltage to said common pixel electrode is configured to adjust said voltage applied to said common pixel electrode to bring said measured applied voltage towards said change in voltage on said common pixel electrode due to said voltage induced on said pixel drive electrode.

9. A display system as claimed in claim 8 further comprising a common pixel electrode switch to switch said common pixel electrode between a first, driver setting in which said system to apply a compensation voltage to said common pixel electrode is connected to drive said common pixel electrode, and a second, measure setting in which said common pixel electrode is disconnected from said system to apply a compensation voltage to said common pixel electrode and connected to said analogue-to-digital converter to measure said voltage applied to said common pixel electrode.

10. A display system as claimed in claim 9 wherein said common pixel electrode switch has a third, off setting in which said common pixel electrode is substantially disconnected from said display driver.

11. A display system as claimed in claim 9, wherein said measure select switch is further configured to switch said analogue input to a signal from said common pixel electrode when said common pixel electrode switch is in said second, measure setting.

12. A method of compensating for an induced voltage in an electrooptic display coupled to a display driver, said electrooptic display having a plurality of pixels each with a pixel drive electrode driven by a pixel driver circuit, said plurality of pixels sharing a common pixel electrode, said pixel driver circuits each comprising a pixel select line to select the pixel, a pixel data line to receive pixel data for driving the pixel, and a pixel drive line coupled to said pixel drive electrode to drive said pixel drive electrode with a signal dependent on said pixel data, said induced voltage comprising a voltage induced on said pixel drive electrode by a changing voltage on said pixel select line, the method comprising:

storing display compensation data defining a relationship between a voltage swing in said pixel select line and a said induced voltage on said pixel drive electrode;

measuring, using an analogue-to-digital converter in a voltage compensation drive circuit of said display, a voltage swing on said pixel select line applied by said display driver;

determining an ideal compensation voltage, using said voltage compensation drive circuit of said display, to apply to said common pixel electrode using said display compensation data and said determined voltage swing wherein said ideal compensation voltage compensates for said voltage induced on said pixel drive electrode;

applying a compensation voltage, using a digital-to-analogue converter in said voltage compensation driver circuit to said common pixel electrode wherein said digital-to-analogue converter has a digital input, a reference voltage input and an analogue input;

measuring, using said analogue-to-digital converter, said compensation voltage applied by said voltage compensation driver circuit to said common pixel electrode; and determining a correction to said compensation voltage applied by said voltage compensation driver circuit to bring said measured applied compensation voltage towards said determined ideal compensation voltage, wherein determining said ideal compensation voltage is dependent on a combination of:

said reference voltage input of said digital-to-analogue converter;

a voltage offset, wherein said voltage offset is a minimum voltage applied to said common pixel electrode as measured by said analogue-to-digital converter; and a voltage span, wherein said voltage span is a difference between a maximum voltage applied to said common pixel electrode as measured by said analogue-to-digital converter and said minimum voltage.

13. A method as claimed in claim 12 comprising repeating said measuring and said determining a correction to said compensation voltage to iteratively converge towards said determined ideal compensation voltage.

14. A method as claimed in claim 12 wherein said induced voltage comprises a voltage induced on said pixel drive electrode, on deselection of said pixel select line, by capacitative coupling between said pixel drive electrode and said pixel select line or a portion of said pixel driver circuit connected to said pixel select line.

15. A method as claimed in claim 12 wherein said determining a correction of said compensation voltage comprises adjusting a value of a variable calculated by multiplying a scaling value, between said voltage swing and said induced voltage, defined by said display compensation data, by a constant.

16. A method as claimed in claim 12 wherein said applying a compensation voltage using said voltage compensation driver circuit comprises multiplying a value from said determining of said ideal compensation voltage, by a value dependent on said measured voltage swing, using said voltage compensation driver circuit.

17. A method as claimed in claim 16 wherein said multiplying comprises applying one of said values to the digital input of said digital-to-analogue converter and the other of said values to said reference voltage input of said digital-to-analogue converter.

18. A method as claimed in claim 17 wherein said applying a compensation voltage using said voltage compensation driver circuit further comprises amplifying an analogue output of said digital-to-analogue converter.

19. A method as claimed in claim 17 further comprising adding said voltage offset to an analogue output of said digital-to-analogue converter, wherein said voltage off-set is proportional to said determined voltage swing.

20. A method of compensating for an induced voltage in an electrooptic display coupled to a display driver, said electrooptic display having a plurality of pixels each with a pixel drive electrode driven by a pixel driver circuit, said plurality of pixels sharing a common pixel electrode, said pixel driver circuit comprising a pixel select line to select a pixel, a pixel data line to receive pixel data for driving the pixel, and a pixel drive line coupled to said pixel drive electrode to drive said pixel drive electrode with a signal dependent on said pixel data, said induced voltage comprising a voltage induced on said pixel drive electrode by a changing voltage on said pixel select line, the method comprising:

writing a reference pixel data value to said pixel;

measuring a change in voltage on said common pixel electrode due to said voltage induced on said pixel drive electrode;

adjusting a voltage compensation driver circuit coupled to said common pixel electrode, responsive to said measured change in voltage, to apply a compensation voltage to said common pixel electrode to compensate for said measured change in voltage, wherein said reference pixel data value defines a zero value of said signal on said pixel drive electrode and wherein said writing of said reference pixel data value comprises writing a plurality of null frames to said electrooptic display, in a said null frame each of said plurality of pixels having said reference pixel data value, and wherein said measuring comprises making a said measurement of said change in voltage for each of said null frames and averaging said measurements.

21. A method as claimed in claim 20 further comprising sensing a temperature of said display, and wherein said compensating is applied dependent on said sensed temperature.

22. A method as claimed in claim 12 or claim 20 wherein said pixel driver circuits are fabricated on a backplane, wherein said pixel driver circuit comprises a transistor having drain, source and gate connections, said gate connection being coupled to said pixel select line, one of said drain and source connections being coupled to said pixel data line, the other to said pixel drive line, and wherein said induced voltage comprises a gate kickback voltage.

23. A method as claimed in claim 12 or claim 20 wherein said electrooptic display is an electrophoretic display.

24. A method as claimed in claim 12 or claim 20 wherein said pixel driver circuits are fabricated by solution deposition techniques.

25. A method as claimed in claim 20 further comprising:

controlling said voltage compensation driver circuit to apply an approximate said compensation voltage to said common pixel electrode;

measuring said approximate compensation voltage; and adjusting said controlling of said voltage compensation driver circuit to bring said measured approximate compensation voltage towards said measured change in voltage on said common pixel electrode.

26. A method as claimed in claim 25 further comprising determining a voltage swing on said pixel select line applied by said display driver;

wherein said controlling of said voltage compensation driver circuit comprises multiplying a first value dependent on said approximate compensation voltage by a second value dependent on said voltage swing;

wherein said multiplying comprises applying one of said values to the digital input of a digital-to-analogue converter and the other of said values to a reference voltage input of said digital-to-analogue converter; and wherein said adjusting of said controlling comprises adjusting said first value.

27. A method as claimed in claim 26 further comprising adding a voltage offset to an analogue output of said digital-to-analogue converter, wherein said voltage offset is proportional to said determined voltage swing.

28. A method as claimed in claim 25 comprising:

measuring said approximate compensation voltage and said change in voltage on said common pixel electrode using shared measurement circuitry;

switching an input of said shared measurement circuitry between an output of said voltage compensation driver circuit and said common pixel electrode, and switching said output of said voltage compensation driver circuit off said common pixel electrode when said shared measurement circuitry is measuring said change in voltage on said common pixel electrode.

29. A method as claimed in claim 28 further comprising switching said common pixel electrode into a disconnected state when not writing said reference pixel data value or measuring said change in voltage on said common pixel electrode.

30. A method as claimed in claim 25 further comprising:

storing display compensation data defining a relationship between a voltage swing in said pixel select line and a said induced voltage on said pixel device electrode;

determining a voltage swing on said pixel select line applied by said display driver; and determining said approximate compensation voltage applied to said common pixel electrode using said display compensation data and said determined voltage swing.

31. A method as claimed in claim 30 further comprising updating said stored display compensation data using said measured change in said voltage on said common pixel electrode.

32. A method as claimed in claim 20, further comprising:

determining an ideal operation voltage for said common pixel electrode dependent upon a combination of:

a reference voltage input of a analogue-to-digital converter which measures said voltage applied to said common pixel electrode;

a voltage offset, wherein said voltage offset is a minimum voltage applied to said common pixel electrode as measured by said analogue-to-digital converter; and a voltage span, wherein said voltage span is a difference between a maximum voltage applied to said common pixel electrode as measured by said analogue-to-digital converter and said minimum voltage; and determining a correction to said voltage applied to said common pixel electrode responsive to said ideal operation voltage.

33. A method as claimed in claim 32, further comprising:

determining an error in a voltage on an input of a digital-to-analogue converter which applies said correction, wherein said error is a function of said maximum digital input value of said digital-to-analogue converter and is dependent upon:

said ideal operation voltage of said common pixel electrode, said measured voltage applied to said common pixel electrode, and said voltage span of said digital-to-analogue converter.

34. A method as claimed in claim 33, further comprising implementing an error correction procedure to correct for said error in said voltage on said digital input, wherein said error correction procedure comprises:

calculating said error, adjusting said digital input value by adding said error to said digital input, and iterating said procedure until an absolute magnitude of said error is less than a resolution of said digital-to-analogue converter.

* * * * *